US008323729B2

(12) United States Patent
Inoue et al.

(10) Patent No.: US 8,323,729 B2
(45) Date of Patent: Dec. 4, 2012

(54) PROCESS FOR PRODUCING METAL MEMBER, STRUCTURAL MEMBER WITH THUS PRODUCED METAL MEMBER, AND METHOD OF REPAIRING METAL MEMBER USING SHOT PEENING

(75) Inventors: Akiko Inoue, Nagoya (JP); Takahiro Sekigawa, Nagoya (JP); Kazuyuki Oguri, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 325 days.

(21) Appl. No.: 12/666,060

(22) PCT Filed: Oct. 2, 2008

(86) PCT No.: PCT/JP2008/067952

§ 371 (c)(1),
(2), (4) Date: Dec. 22, 2009

(87) PCT Pub. No.: WO2009/044825

PCT Pub. Date: Apr. 9, 2009

(65) Prior Publication Data

US 2011/0008633 A1 Jan. 13, 2011

(30) Foreign Application Priority Data

Oct. 5, 2007 (JP) ..... 2007-261762

(51) Int. Cl.
*B05D 3/12* (2006.01)
*B05D 1/36* (2006.01)
*B32B 15/20* (2006.01)

(52) U.S. Cl. ..... 427/142; 727/327; 727/328; 428/623

(58) Field of Classification Search ..... 427/142, 427/327, 328; 428/623
See application file for complete search history.

(56) References Cited

U.S. PATENT DOCUMENTS 5,578,347 A * 11/1996 Chan ..... 427/336
5,827,573 A * 10/1998 Tsai ..... 427/327
5,869,140 A * 2/1999 Blohowiak et al. ..... 427/307
2008/0044563 A1 2/2008 Kobayashi et al.

FOREIGN PATENT DOCUMENTS

CA 2 592 523 7/2006

(Continued)

OTHER PUBLICATIONS

International Search Report issued Nov. 4, 2008 in International (PCT) Application No. PCT/JP2008/067952.

(Continued)

*Primary Examiner* — Frederick Parker
(74) *Attorney, Agent, or Firm* — Wenderoth, Lind & Ponack, L.L.P.

(57) ABSTRACT

A process for producing a metal member that enables both the fatigue properties and the corrosion resistance of the member to be improved, a structural member that includes a thus produced metal member, and a method of repairing a metal member. The process for producing a metal member comprises a projecting particles having an average particle size of not more than 200 μm onto the surface of a metal material comprising an aluminum alloy using compressed air or a compressed gas, and a chemical conversion treatment including forming a film on the surface of the metal material by performing a chemical conversion treatment following projecting the particles.

8 Claims, 1 Drawing Sheet

FOREIGN PATENT DOCUMENTS

| | | | |
|---|---|---|---|
| EP | 1 862 569 | | 12/2007 |
| JP | 9-78254 | | 3/1997 |
| JP | 9-262770 | | 10/1997 |
| JP | 10-099779 | * | 4/1998 |
| JP | 2003-003295 | | 1/2003 |
| JP | 2003-311210 | | 11/2003 |
| JP | 2006-188720 | | 7/2006 |
| WO | 2005/063443 | | 7/2005 |

OTHER PUBLICATIONS

T. Dorr et al, "Influence of Shot Penning on Fatigue Performance of High-Strength Aluminum- and Magnesium Alloys", pp. 153-160, the 7th International Conference on Shot Peening, 1999, Institute of Precision Mechanics, Warsaw, Poland. Internet <URL: http://www.shotpeening.org/ICSP/icsp-7-20.pdf>.

Canadian Office Action issued May 27, 2010 in corresponding Canadian Application No. 2,691,222.

G. Cholvy et al., "Evaluation of aluminum coatings for protection against corrosion of aluminum alloys and steel used in aeronautical industry", Le Vide, les couches minces (1992), vol. 48, No. 260, p. 17-24 w/Abstract.

V.C. McMillan, "Corrosion fatigue of 2219-T87 aluminum alloy", NASA Technical Memorandum (1986), NASA-TM-86537.

K. Takeuchi et al, "Effect of surface treatments on the fatigue strength of aluminum alloys", Sumitomo Keikinzoku Giho (1970), 11(1), p. 77-81 w/Abstract.

Japanese Decision to Grant a Patent issued Aug. 14, 2012 in corresponding Japanese Application No. 2007-261762.

* cited by examiner

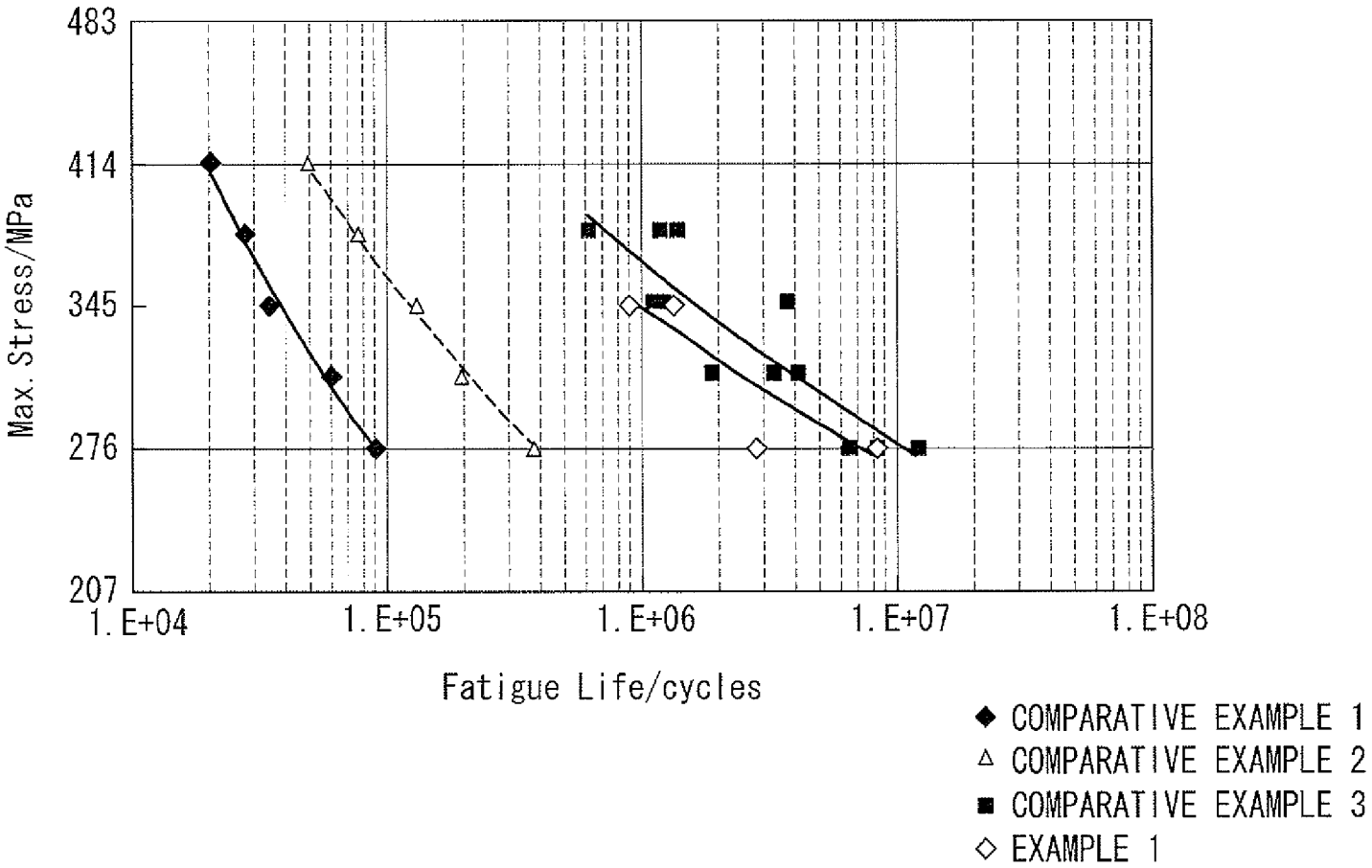
483
414
345
276
207
Max. Stress/MPa
1. E+04
1. E+05
1. E+06
1. E+07
1. E+08
Fatigue Life/cycles
COMPARATIVE EXAMPLE 1
COMPARATIVE EXAMPLE 2
COMPARATIVE EXAMPLE 3
EXAMPLE 1

PROCESS FOR PRODUCING METAL MEMBER, STRUCTURAL MEMBER WITH THUS PRODUCED METAL MEMBER, AND METHOD OF REPAIRING METAL MEMBER USING SHOT PEENING

BACKGROUND OF THE INVENTION

I. Technical Field

The present invention relates to a process for producing a metal member having improved fatigue properties and corrosion resistance, and also relates to a structural member that includes a thus produced metal member, and a method of repairing a metal member.

II. Description of the Related Art

Shot peening represents a known example of a surface modification process that is used for enhancing the fatigue strength of metal materials within the structural members and the like used in aircraft and automobiles and the like (see T. Dorr and four others, "Influence of Shot Penning on Fatigue Performance of High-Strength Aluminum- and Magnesium Alloys", The 7th International Conference on Shot Peening, 1999, Institute of Precision Mechanics, Warsaw, Poland. Internet <URL: http://www.shotpeening.org/ICSP/icsp-7-20.pdf>). Shot peening is a process in which, for example, by blasting countless particles having a particle size of approximately 0.8 mm (the shot material) together with a stream of compressed air or a compressed gas onto the surface of a metal material, indentations are formed in the surface of the metal material as a result of plastic deformation, while at the same time, the hardness of the metal material surface is increased, and a layer having compressive residual stress is formed at a certain depth.

Furthermore, shot peening treatments that employ non-metallic hard particles as the shot particles are also known. For example, ceramic particles with a particle size of not less than 150 μm, and glass-based particles comprising not less than 50% of silica SiO2 as the main constituent are widely used as shot particles.

Furthermore, in those cases where an aluminum alloy member is used as a metallic material, the material is typically subjected to an anodic oxidation treatment or the like followed by painting in order to improve the corrosion resistance and the like (see Japanese Unexamined Patent Application. Publication No. 2003-3295).

This anodic oxidation treatment is an electrolytic treatment in which, for example, an acid such as chromic acid, phosphoric acid, boric acid or sulfuric acid is used as the electrolyte and the metal material functions as the anode.

SUMMARY OF THE INVENTION

However, as described in Japanese Unexamined Patent Application, Publication No. 2003-3295, because the anodic oxidation treatment of the surface of an aluminum alloy involves a technique in which an electric potential is applied to the surface within an acidic solution, during the film formation process, corrosion of the surface due to the acid and galvanic corrosion also occur simultaneously. Furthermore, corrosion of the surface due to acid also occurs in the acidic solution cleaning process that is typically conducted as a pretreatment. The pits formed by this corrosion tend to facilitate electrical corrosion of the aluminum alloy. Accordingly, depending on the composition of the aluminum alloy, pits may be formed in the surface of the aluminum alloy as a result of intergranular corrosion, pitting corrosion, or galvanic corrosion or the like. These pits tend to act as origins for the development or propagation of cracks during fatigue breakdown, and depending on the size of the pits, may cause reductions in the material strength and fatigue life. Accordingly, a problem arises in that although corrosion resistance can be ensured, strength properties that have been enhanced by shot peening, and particularly the fatigue properties, tend to deteriorate.

An anodic oxidation film has a higher hardness than the aluminum alloy of the base material, and because the difference in hardness relative to the base material is large, factors such as the thickness of the film and the nature of the film may cause a deterioration in the fatigue strength.

Furthermore, because a film formed by an anodic oxidation treatment contains a multitude of micropores that are open at the surface of the film, a sealing treatment that fills these micropores is typically used to enhance the film density. However, performing this type of sealing treatment smoothes the film surface, meaning a satisfactory anchoring effect may not be achievable if a subsequent coating is applied. As a result, the paint adhesiveness tends to deteriorate following film deposition, which can lead to problems that result in inferior corrosion resistance, such as peeling of the coating film.

The present invention has been developed in light of these circumstances, and has an object of providing a process for producing a metal member that enables both the fatigue properties and the corrosion resistance of the member to be improved, as well as providing a structural member that includes a thus produced metal member, and a method of repairing a metal member.

In order to achieve the above object, the present invention adopts the aspects described below.

Namely, a first aspect of the present invention provides a process for producing a metal member, the process comprising: a projection step of projecting particles having an average particle size of not more than 200 μm onto a surface of a metal material comprising an aluminum alloy using compressed air or a compressed gas, and a chemical conversion treatment step of forming a film on the surface by performing a chemical conversion treatment following the projection step.

In this process, because particles having an average particle size of not more than 200 μm are projected, a metal member having improved fatigue properties can be produced without substantially changing the surface roughness of the metal material comprising an aluminum alloy.

Furthermore, because the film is formed by a chemical conversion treatment that does not require application of an electric potential, defects such as pitting corrosion are not generated on the surface of the aluminum alloy. As a result, the improvement in the fatigue properties can be substantially maintained.

Moreover, the treatment time for the chemical conversion treatment is short, meaning the production time for the metal member can be shortened.

In the aspect described above, the "average particle size" is determined as the particle size corresponding with the peak in a frequency distribution curve, and is also referred to as the most frequent particle size or the modal diameter. Alternatively, the average particle size may also be determined using the methods listed below.

(1) A method in which the average particle size is determined from a sieve curve (the particle size corresponding with R=50% is deemed the median diameter or 50% particle size, and is represented using the symbol $d_{p50}$).

(2) A method in which the average particle size is determined from a Rosin-Rammler distribution.

(3) Other methods (such as determining the number average particle size, length average particle size, area average particle size, volume average particle size, average surface area particle size, or average volume particle size).

Further, in the above aspect, a configuration in which the particles comprise essentially no iron is preferred.

Moreover, in this configuration, particles that comprise a non-metallic hard material or a nonferrous hard material as the main constituent are even more desirable.

By employing such a configuration, no residual iron fraction is left on the surface of the metal material, meaning localized cell corrosion caused by such residual iron does not occur. As a result, an iron fraction removal step using an acidic or alkaline solution is unnecessary, meaning problems such as dimensional change or surface roughening of the metal material caused by such an iron fraction removal step can be prevented.

Furthermore, an iron fraction removal step that is achieved via a cleaning step performed after shot peening is also unnecessary, which facilitates use of the above configuration in the repair of actual equipment either during operation or during production.

Furthermore, in the aspect or configuration described above, a coating step of forming a coating film may be provided following the chemical conversion treatment step.

This enables the corrosion resistance to be further improved.

A second aspect of the present invention provides a structural member that includes a metal member produced using the production process described above.

The structural member according to this aspect not only has excellent fatigue properties, but also exhibits improved corrosion resistance and coating adhesiveness compared with the base material. This structural member can be used favorably in the field of transportation machinery such as aircraft and automobiles, and in other fields that require favorable material fatigue properties and corrosion resistance.

Furthermore, a third aspect of the present invention provides a method of repairing a metal member, the method comprising using the production process described above to repair defects or scratches that have been introduced on a surface of a metal member.

A metal member surface that has been repaired using the repair method of this aspect not only has excellent fatigue properties, but also exhibits improved corrosion resistance and coating adhesiveness compared with the base material.

By employing the present invention in the production of metal members such as structural members, metal members having improved fatigue properties can be produced without substantially changing the surface roughness of the metal material over the course of the projection step.

Furthermore, because no defects such as pitting corrosion defects are generated on the surface of the aluminum alloy, the improvement in the fatigue properties can be substantially maintained, and the corrosion resistance can be improved.

Moreover, because the chemical conversion treatment requires a shorter treatment time than an anodic oxidation treatment, the production time for the metal member can be shortened.

BRIEF DESCRIPTION OF THE DRAWINGS

FIG. 1 is a graph illustrating the results of fatigue testing.

DETAILED DESCRIPTION OF THE INVENTION

A description of an embodiment of the process for producing a metal member according to the present invention is presented below.

In the process for producing a metal member according to the present invention, an aluminum alloy material (a metal material) or the like is used.

In the process for producing a metal member according to the present invention, the particles (the shot material) used in the shot peening treatment of the aluminum alloy material (the projection step) comprise a non-metallic hard material as the main constituent, and are preferably ceramic particles such as alumina or silica particles. Namely, the particles do not comprise iron as the main constituent, or in other words, comprise essentially no iron.

In conventional shot peening treatments, a shot material with a particle size of approximately 0.8 mm is typically used, but in the present invention, a shot material having an average particle size of not more than 200 μm is used. The average particle size of the shot material is preferably not less than 10 μm and not more than 200 μm, and is more preferably not less than 30 μm and not more than 100 μm.

If the average particle size of the shot material is greater than 200 μm, then the excessively large kinetic energy of the particles may damage the material surface, meaning a satisfactory improvement in the fatigue life cannot be achieved. In contrast, if the average particle size of the shot material is smaller than 10 μm, then blockages and the like of the shot material make it difficult to achieve a stable blast state.

The blast speed of the shot material is regulated by the blast pressure of the compressed gas. Examples of the compressed gas include air, nitrogen, hydrogen, and inert gases such as argon and helium. In the shot peening treatment of the present invention, the blast pressure is preferably not less than 0.1 MPa and not more than 1 MPa, and is more preferably not less than 0.3 MPa and not more than 0.6 MPa.

If the blast pressure is greater than 1 MPa, then the excessively large kinetic energy of the particles may damage the material surface, meaning a satisfactory improvement in the fatigue life cannot be achieved. Moreover, rupture of the particles may cause increased wastage, and re-collision of the ruptured particles with the surface of the metal member may damage the surface. In contrast, if the blast pressure is less than 0.1 MPa, then not only are the particles not accelerated sufficiently, but the compressed air is unable to be supplied at a stable pressure, meaning achieving a stable blast state becomes very difficult.

On the other hand, if the intensity of the shot peening is expressed in terms of the arc height value (the intensity) determined using an Almen gauge system, then a value of not less than 0.002 N is preferred.

The shot material particles are preferably a spherical shape. The reason for this preference is that if the shot material particles are sharp, then the surface of the metal member may become damaged.

The coverage of the shot peening treatment is preferably not less than 100% and not more than 1,000%, and is more preferably not less than 100% and not more than 500%.

At coverage levels less than 100%, a satisfactory improvement in the fatigue strength cannot be obtained. Further, if the coverage level exceeds 1,000%, then an increase in the temperature at the material surface causes a reduction in the compressive residual stress at the outermost surface, meaning a satisfactory improvement in fatigue strength cannot be obtained.

A metal member that has been subjected to shot peening under the conditions described above preferably exhibits the surface properties (surface compressive residual stress and surface roughness) described below.

[Surface Compressive Residual Stress]

In a metal member that has undergone a shot peening treatment in accordance with the present invention, a high compressive residual stress of not less than 150 MPa exists either at the outermost surface of the material, or within the vicinity thereof. As a result, the surface is strengthened and fatigue failure occurs not at the surface, but within the interior of the material, meaning the fatigue life increases significantly.

[Surface Roughness]

The shot peening treatment according to the present invention is performed so that the surface roughness is substantially unchanged over the course of the treatment. The difference between the surface roughness prior to the shot peening treatment and the surface roughness following the shot peening treatment can be suppressed to a difference in the centerline average roughness Ra of not more than 1 μm.

The surface of this metal member is cleaned, including a degreasing treatment that removes oil and fat components adhered to the surface.

Subsequently, in those cases where, for example, a passive film such as an oxide film is adhered to the surface of the metal member, an activation treatment is performed to remove this passive film.

A chemical conversion treatment is then performed, either by dipping the surface of the metal member in a treatment liquid, or by coating or spraying the treatment liquid onto the surface, thereby forming a film on the metal surface.

Unlike electrical treatments such as anodic oxidation treatments, the chemical conversion treatment utilizes a chemical reaction between the treatment liquid and the aluminum, and therefore does not generate pitting corrosion or other defects on the surface of the metal member. As a result, the improvement in the fatigue properties provided by the shot peening treatment can be substantially maintained while the corrosion resistance is improved.

Furthermore, the chemical conversion treatment can not only be conducted at comparatively low cost, via a relatively simple operation and in a short period of time, but can also be used within a continuous treatment, and is capable of producing a uniform treatment even for members having a complex shape.

As a result, a uniform film can be formed that conforms to the indentations (dimples) formed in the surface of the metal member as a result of the shot peening treatment, meaning dimples of substantially the same shape as those in the surface of the metal member are formed in the surface of the film.

The Alodine method, which enables the formation of a chromate-based film or chromate/phosphate-based film that exhibits extremely favorable adhesiveness and excellent corrosion resistance, is ideal for the chemical conversion treatment. Other methods such as MBV methods, boehmite methods and phosphate methods may also be used for the chemical conversion treatment.

The thickness of the film formed by the chemical conversion treatment is preferably not more than 5 μm, and is more preferably not less than 0.1 μm and not more than 0.3 μm.

The chemical conversion film formed in this manner exhibits favorable adhesiveness, and is capable of improving the corrosion resistance of the underlying base material.

Subsequently, following cleaning and drying of the surface of the film formed by the chemical conversion treatment, a coating step of forming a coating film is performed.

Because the surface of the film includes dimples, the inherent favorable adhesiveness of the film combines with an anchoring effect provided by the dimples, enabling the coating film to be formed with excellent adhesion.

This coating film produces an additional improvement in the corrosion resistance of the metal member.

A more detailed description of the process for producing a metal member according to the present invention is presented below using a series of examples and comparative examples.

Example 1

A sheet of an aluminum alloy material (7050-T7451, dimensions: 19 mm×76 mm×2.4 mm) was used as a test piece. One surface of this test piece was subjected to a shot peening treatment using a shot material composed of alumina/silica ceramic particles having an average particle size (most frequent particle size) of not more than 53 μm, under conditions including a blast pressure of 0.4 MPa and a treatment time of 30 seconds. The arc height during the treatment was 0.003 N.

A gravity-type fine particle shot apparatus was used as the shot peening apparatus.

The aluminum alloy material had a surface roughness Ra of 1.2 μm prior to the shot peening treatment. The surface roughness Ra following the shot peening treatment was 1.4 μm.

Following the shot peening treatment, the shot peened surface of the aluminum alloy material was subjected to degreasing, cleaning and activation.

This surface was then dipped in a commercially available chemical conversion treatment liquid "Alodine 1200" for 120 seconds at room temperature, thereby forming a chromate-based film. The thickness of the film was 3 μm.

Following completion of the chemical conversion treatment, an electrical hydraulic fatigue tester (Hydract tester (±50 kN), INSTRON 8400 controller) was used to perform a fatigue test on the test piece.

Fatigue tests were performed using two different maximum loadings of 276 MPa and 345 MPa (40 KSI and 50 KSI), and each test was performed by applying repeated tension-tension loads (stress ratio: 0.1), and measuring the number of load repetitions at the point of test piece rupture.

The results of the fatigue testing for example 1 are illustrated in FIG. 1.

Comparative Example 1, Comparative Example 2, and Comparative Example 3

Comparative example 1 represents a machined test piece prior to the shot peening treatment described in example 1.

Comparative example 2 represents a machined test piece of comparative example 1 that has been subjected to a shot peening treatment with conventional zirconia particles having an average particle size (most frequent particle size) of 250 μm.

Comparative example 3 represents a test piece following the shot peening treatment of example 1.

The results of subjecting the test pieces from comparative example 1, comparative example 2 and comparative example 3 to the same fatigue test as example 1 are illustrated in FIG. 1.

As is evident from the results in FIG. 1, the shot peening treatment of example 1 and comparative example 3 that used a fine particle shot material produced a 20- to 25-fold increase in fatigue strength compared with the shot peening treatment of comparative example 2 that used a conventional shot material, and produced an approximately 100-fold increase in fatigue strength compared with the comparative example 2 in which no shot peening treatment was performed, enabling the production of an aluminum alloy member with dramatically improved fatigue properties.

Further, the results for example 1, in which a chemical conversion treatment was performed, exhibited almost no deterioration in the fatigue properties compared with comparative example 3 in which no chemical conversion treatment was performed, with the fatigue properties of comparative example 3 being substantially maintained.

Example 2

Using a sheet of an aluminum alloy material (2024, dimensions: 19 mm×76 mm×2.4 mm) as a test piece, the same treatments as example 1 (namely, a shot peening treatment using a fine particle shot material and a chemical conversion treatment) were performed.

The surface of the film formed in the chemical conversion treatment was cleaned and dried, and an epoxy-based resin was then applied to the film and dried for 1.5 hours at a temperature of not more than 93° C.

Comparative Example 4

With the exception of performing an anodic oxidation treatment using boric acid/sulfuric acid anodization (see U.S. Pat. No. 4,894,127) instead of the chemical conversion treatment, treatments were performed in the same manner as example 2.

The test pieces from example 2 and comparative example 4 were subjected to a corrosion resistance test and a coating adhesion test.

The corrosion resistance test was executed by performing a salt water spray test in which salt water having a concentration of not more than 0.3% and a temperature of approximately 35° C. was sprayed onto the test piece for 168 hours. The results of this test revealed that in both example 2 and comparative example 4, five or more spot-like defects could not be found on the test piece surface.

The coating adhesion test was conducted under both dry and wet conditions using a tape manufactured by Sumitomo 3M Limited (see ASTM D 3330). The test results confirmed that example 2 and comparative example 4 both exhibited favorable coating adhesive strength.

Example 3

In order to evaluate a repair method, a flat aluminum alloy fatigue test piece (7050) having a stress concentration factor of 1.5 was prepared, and this test piece was subjected to shot peening using the same process as that described for example 1. The shot peening was performed after wedge-shaped scratches having a width of approximately 200 μm and a depth of approximately 100 μm had been formed in both the load direction and the horizontal direction at the corners of the fatigue test piece. Subsequently, a fatigue test was performed using the same fatigue tester as that used in example 1.

The results of the above tests revealed that for the test piece that had not undergone shot peening, test piece rupture occurred after 151,110 repetitions, whereas the test piece that had been subjected to the shot peening treatment ruptured after 1,370,146 repetitions, representing an improvement in the fatigue life of approximately one order of magnitude.

The invention claimed is:

1. A process for producing a metal member, the process comprising:

a shot peening treatment including projecting particles having an average particle size of not more than 200 μm onto a surface of a metal material comprising an aluminum alloy using a compressed gas, and a chemical conversion treatment including forming a film on the surface of the metal material by performing a chemical conversion treatment following the shot peening treatment, wherein an intensity of the projecting particles expressed in an arc height value determined using an Almen gauge system is not less than 0.002 N.

2. The process for producing a metal member according to claim 1, wherein the particles do not comprise iron as a most abundant constituent.

3. The process for producing a metal member according to claim 2, wherein the particles comprise a non-metallic material or a nonferrous material as a most abundant constituent.

4. The process for producing a metal member according to claim 1, further comprising forming a coating following the chemical conversion treatment.

5. The process for producing a metal member according to claim 1, wherein the particles are a spherical shape.

6. The process for producing a metal member according to claim 1, wherein a coverage of the shot peening treatment is not less than 100% and not more than 1,000%.

7. A method of repairing a metal member to repair defects or scratches that have been introduced on a surface of a metal member, the method comprising;

a shot peening treatment including projecting particles having an average particle size of not more than 200 μm onto a surface of a metal material comprising an aluminum alloy using a compressed gas, and a chemical conversion treatment including forming a film on the surface of the metal material by performing a chemical conversion treatment following the shot peening treatment step wherein, an intensity of the projecting particles expressed in an arc height value determined using an Almen gauge system is not less than 0.002 N.

8. A structural member comprising a metal member produced using the process according to claim 1.

* * * * *